US006454858B1

(12) United States Patent
Oki et al.

(10) Patent No.: US 6,454,858 B1
(45) Date of Patent: Sep. 24, 2002

(54) CURTAIN COATING APPARATUS

(75) Inventors: Kazuhiro Oki; Yoshinobu Katagiri, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 155 days.

(21) Appl. No.: 09/593,951

(22) Filed: Jun. 15, 2000

(30) Foreign Application Priority Data

Jun. 15, 1999 (JP) ..... 11-168473

(51) Int. Cl.[7] ..... B05D 1/30
(52) U.S. Cl. ..... 118/410; 118/DIG. 4; 427/420
(58) Field of Search ..... 118/DIG. 4, 324, 118/410; 427/420, 402

(56) References Cited

U.S. PATENT DOCUMENTS

| | | | | |
|---|---|---|---|---|
| 3,632,403 A | | 1/1972 | Greiller | |
| 5,338,359 A | * | 8/1994 | Conroy et al. | 118/DIG. 4 |
| 5,837,324 A | * | 11/1998 | Yapel et al. | 118/DIG. 4 |
| 6,248,406 B1 | * | 6/2001 | Kondo et al. | 118/DIG. 4 |

FOREIGN PATENT DOCUMENTS

| | | |
|---|---|---|
| DE | 25 42 819 | 4/1976 |
| EP | 796 666 | 9/1997 |
| JP | 63 287575 | 11/1988 |
| JP | 10 309506 | 11/1998 |
| JP | 2000-126663 | 5/2000 |

* cited by examiner

*Primary Examiner*—Richard Crispino
*Assistant Examiner*—Yewebdar T T.
(74) *Attorney, Agent, or Firm*—Sughrue Mion, PLLC

(57) ABSTRACT

The curtain coating apparatus of the invention comprises a sliding face on which a coating solution flows down, a coating width regulating plate which is located on each of both sides of the sliding face and regulates the width of the flow of the coating solution, and an edge guide which is connected to the width regulating plate, and keeps both side edges of free falling stream of the coating solution from the sliding face, wherein a contact angle of water with the coating width regulating plate is greater than a contact angle of water with the edge guide, and the apparatus has solved problems of streaks and uneven thickness at side end portions of a free falling film caused by contraction and teapot phenomenon (residence), by changing wett properties at a coating width regulating plate and an edge guide.

10 Claims, 2 Drawing Sheets

CURTAIN COATING APPARATUS

BACKGROUND OF THE INVENTION

This invention relates to a curtain coating apparatus which applies various coating composition to a continuously traveling web-shaped support (web) by the curtain coating system, in the production of photographic film, photographic paper, magnetic recording tape, pressure-sensitive recording paper, offset printing plate and the like.

In general, photographic film is manufactured by applying a coating solution comprising a photographic emulsion to a continuously traveling web made of polyethylene terephthalate, followed by drying.

A representative coating apparatus for the coating solution is a curtain coating apparatus. In the curtain coating apparatus, as shown in FIG. 4, one or two or more types of a coating solution 43 are extruded into a film or layered films onto a sliding face 42 of a slide hopper die, and the extruded coating solution 43 film(s) flow down with regulating the width by coating width regulating plates 44 provided on both sides. The coating solution film(s) fall down from the end of the sliding face 42 with keeping both side edges of the film(s) to form a free falling coating solution film (free falling curtain) 46, and the free falling coating solution film is applied to the web 47 as a coating film 48.

In the curtain coating having a sliding face, contraction of the free falling coating solution film is prevented compulsorily by using a pair of edge guides which keep a prescribed coating width. Therefore, various forces act on the stream of the free falling coating solution film around the connection between the coating width regulating plate set of the sliding face and the edge guide, and induce instability.

For example, at the side edges of the free falling coating solution film formed along the edge guide, thinning phenomenon of the film occurs, i.e. thinning and thickening occur caused by the development of a boundary layer, and bending of the free falling coating solution film in the front and rear direction occurs which is called teapot effect. Since the strength of these phenomena greatly depends on the flow rate and viscosity, it is desirable to control these conditions in order to inhibit the occurrence of the tinning phenomenon and the bending phenomenon. However, coating flow rate and viscosity are, in general, restricted according to the type of product, and it is impossible to adjust them freely. As a result, the countermeasure against the occurrence of the thinning phenomenon and the bending phenomenon is taken mechanically, such as the design of a coating width regulating plate and an edge guide.

Under these circumstances, various devices for the coating width regulating plate and the edge guide have been proposed. For example, Japanese Patent KOKAI 51-57734 discloses a film cover composed of two vertical edge guide plates having a width which the edges of a free falling liquid film can follow the passage naturally adjusted by the guide plates Japanese Patent KOKAI 61-245862 discloses a coating apparatus which inhibits disturbance upon film forming by rendering the face width of the vertical face of a stretching means in contact with a side edge of a falling film to the face width corresponding to the thickness of the falling film. Japanese Patent KOKOKU 4-4662 discloses a coating apparatus which improves unevenness of a film thickness on both sides of a free falling curtain by adjusting a guide means of the free falling curtain to a prescribed temperature range. Japanese Patent KOKAI 63-287575 discloses a coating apparatus which is devised so that the stream of a coating solution is not disturbed at the connecting portion between a coating width regulating plate and an edge guide which supports both sides of a film of a coating solution, by processing the section of the edge guide in the same shape as the section of the coating width regulating plate.

However, in the film cover disclosed in Japanese Patent KOKAI 51-57734, the landing point of a curtain film varies by varying the shape of the curtain film according to conditions, such a coating viscosity, flow rate, and the like. Accordingly, when coating was carried out on backing roller, coating surface quality is liable to be influenced by the variation in the vertical distance between a die lip and the landing point. Moreover, it is also a problem that the lower end of a curtain film is liable to be unstable because of not being pinned but being movable forward and backward.

In the coating apparatus disclosed in Japanese Patent KOKAI 61-245862, the shape of the stretching means is special, and must be optimized according to curtain coating conditions. Accordingly, the design of the stretching means is complicated.

In the coating apparatus disclosed in Japanese Patent KOKOKU 4-4662, although the uneven thickness at the side end portions of a free falling curtain film can be improved, the inhibition is small against the generation of streaks caused by the contraction or the teapot phenomenon.

In the coating apparatus disclosed in Japanese Patent KOKAI 63-287575, the inhibition of uneven film thickness at edge guide portions can be improved, but it is desird to further improve the uniformity of the film thickness.

SUMMARY OF THE INVENTION

An object of the invention is to provide a curtain coating apparatus which has solved problems of streaks and uneven thickness at side end portions of a free falling film caused by contraction and teapot phenomenon (residence), by changing wet properties at a coating width regulating plate and an edge guide.

The inventors investigated eagerly in order to achieve the above object, and found that, when the contact angle of water with a coating width regulating plate is greater than the contact angle of water with an edge guide, contraction of stream of a coating solution which occurs in the vicinity of the connection between the coating width regulating plate and the edge guide can be minimized and uneven thickness and the generation of streaks caused by the turbulence of stream can be inhibited.

The present invention has been completed by the findings, and provides a curtain coating apparatus which comprises a sliding face on which a coating solution flows down, a coating width regulating plate which is located on each of both sides of the sliding face and regulates the width of the flow of the coating solution, and an edge guide which is connected to the width regulating plate, and keeps both side edges of free falling stream of the coating solution from the sliding face, wherein a contact angle of water with the coating width regulating plate is greater than a contact angle of water with the edge guide.

Figure 1:
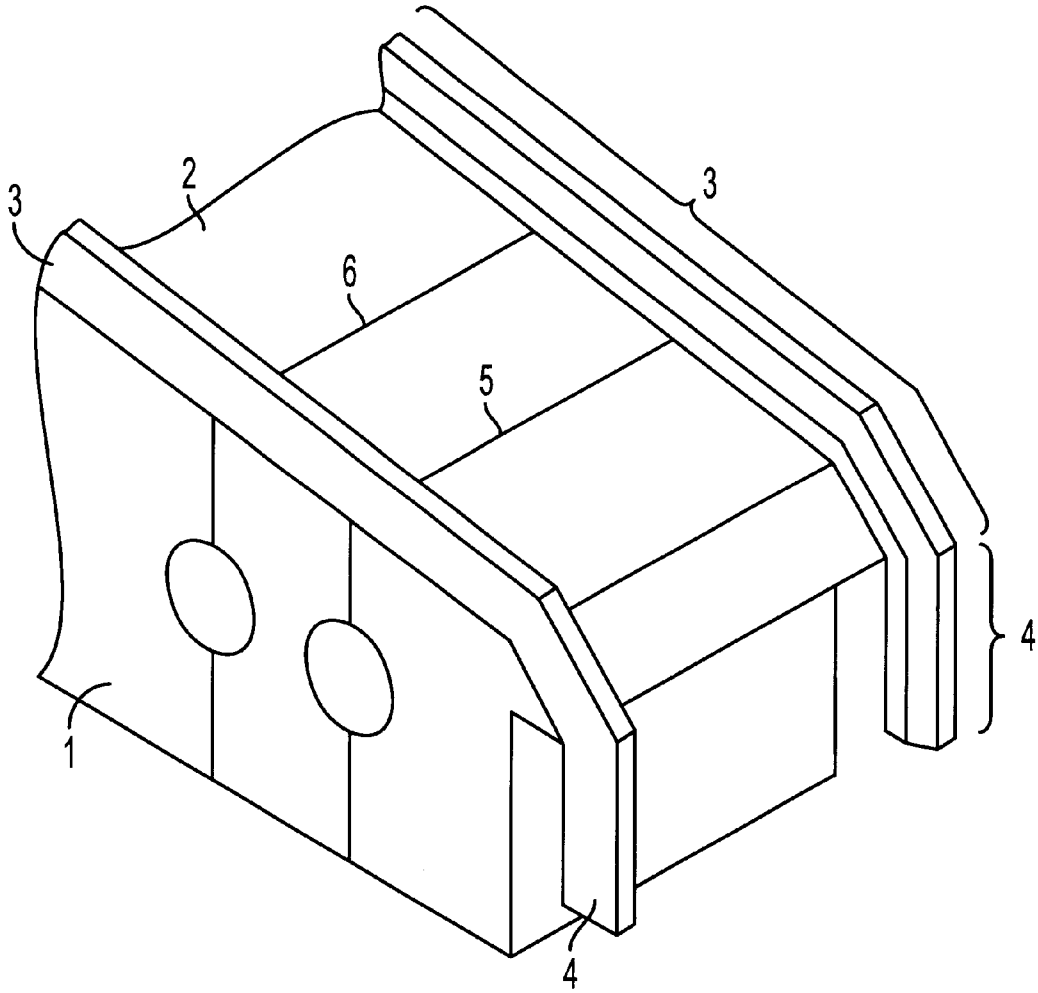
FIG. 1 is a partial schematic perspective view of an embodiment of a curtain coating apparatus of the invention.

1 . . . Slide hopper
2 . . . Sliding face
3 . . . Coating width regulating plate
4 . . . Edge guide
5 . . . Slot
6 . . . Slot
31 . . . Vertical face
32 . . . Inclined face

DETAILED DESCRIPTION OF THE INVENTION

Figure 3:
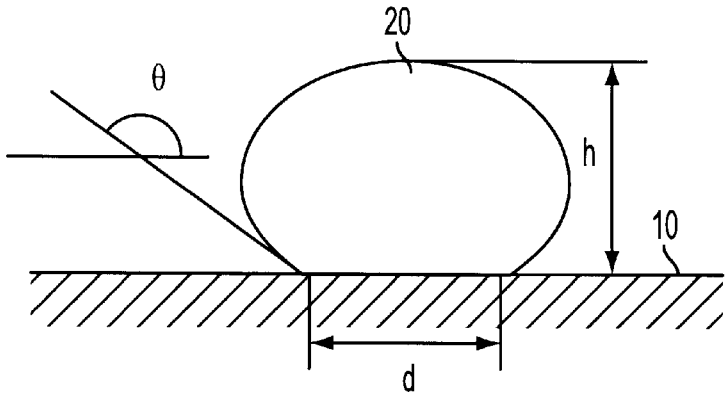
FIG. 3 is a section illustrating a contact angle of water with a coating width regulating plate.
Figure 4:
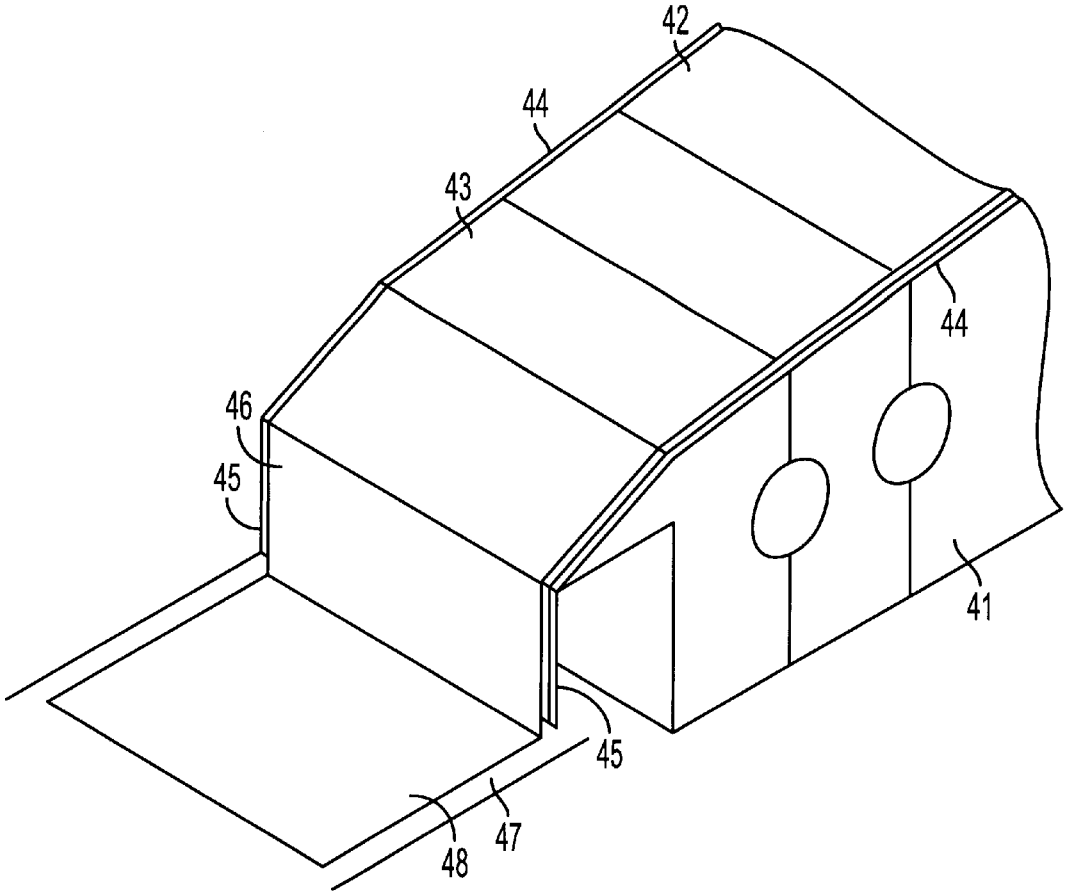
FIG. 4 (PRIOR ART)
FIG. 4 is a partial schematic perspective view of a conventional curtain coating apparatus.

In the curtain coating apparatus of the invention, the contact angle of water with a coating width regulating plate is greater than the contact angle of water with an edge guide connected to the coating width regulating plate. Moreupon, the contact angle is shown by θ in FIG. 3. In the figure, 10 is a plate made of the same material as a coating width regulating plate or an edge guide, and 20 is a water drop. The contact angle can be determined by a conventional means, such as using a goniometer, taking a photograph, calculating by the formula $\tan \theta/2=2h/d$ wherein h is the height of water drop, and d is the diameter of the circle of the contact area with the plate wherein the water drop is estimated to be spherical, or the like.

A preferable contact angle of water with the coating width regulating plate is more than 45 degrees, more preferably 70 to 110 degrees, and a preferable contact angle of water with the edge guide is less than 110 degrees, preferably 15 to 90 degrees. A preferable difference of the contact angle of water with the coating width regulating plate and the contact angle of water with the edge guide is 1 to 100 degrees, more preferably 5 to 90 degrees.

The contact angle can be controlled by forming the coating width regulating plate and the edge guide by a different material from each other, selected from various plastic materials, metals, glasses, woods and the like. The contact angle of each material can be determined by the above means.

In addition, the contact angles of water with some plastic materials are disclosed in D. K. Owens, J. Applied Polymer Science, vol. 13, pp 1741–1747 (1969), etc. A material having a contact angle of less than 95 degrees is polyvinyl chloride (87 degrees), and a material having a contact angle of 95 degrees or more is polytetrafluoroethylene (108 degrees). Thus, a preferable plastic material combination is a coating width regulating plate made of polytetrafluoroethylene and an edge guide made of polyvinyl chloride.

Metals, such as stainless steel and aluminum, and glass are relatively wettable with water, and accordingly, suitable combinations include an edge guide made of a metal, such as stainless steel or aluminum, and a coating width regulating plate made of either polyvinyl chloride or polytetrafluoroethylene.

The difference of the contact angle may be made by a surface treatment, and in this case, the edge guide may be made of the same material as the coating width regulating plate. The surface treatment may be subjected to either one side or both of the coating width regulating plate and edge guide.

As mentioned above, in the invention, it is enough to render the contact angle of water with a coating width regulating plate greater than that with an edge guide connecting to the coating width regulating plate, and the material, surface treatment, and the like are not restricted.

A suitable coating width regulating plate has a lower vertical face and an upper inclined face inclined toward the outside connected to the vertical face, on the coating solution stream side. A preferable height of the vertical face is less than 3 mm, preferably 0.5 to 3 mm for the coating width regulating plate having a contact angle of less than 95 degrees, and 3 to 10 mm, preferably 3 to 5 mm for the coating width regulating plate having a contact angle of 95 degrees or more. Out of the above range, i.e. a contact angle of less than 95 degrees and a height of a vertical face of 3 mm or more, or a contact angle of 95 degrees or more and a height of a vertical face of less than 3 mm, streaks and uneven thickness at both side ends of a free falling coating solution film occur.

Moreover, it is preferable that the inclined face has an angle of 20 to 70 degrees, preferably 30 to 60 degrees. When the angle is more than 60 degrees or less than 30 degrees, streaks and uneven thickness at both side ends of a free falling coating solution film occur.

In the curtain coating apparatus, the edge guide is provided successive to the coating width regulating plate, and has a face meeting the face of the coating width regulating plate on the side of a coating solution stream. When the coating width regulating plate and/or the edge guide are made of a composite material, it is enough that their surfaces contacting the stream of a coating solution satisfy the above contact angle conditions.

Figure 2:
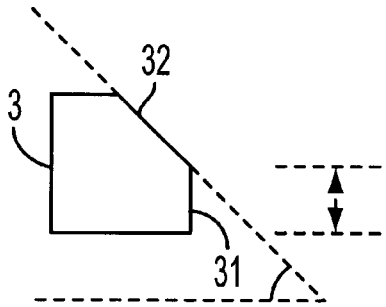
FIG. 2 is a section of a coating width regulating plate used in a curtain coating apparatus of the invention.

An embodiment of the curtain coating apparatus of the invention is illustrated in FIG. 1. The apparatus comprises a slide hopper 1, a sliding face 2 formed on the slide hopper, a pair of coating width regulating plates 3,3, and a pair of edge guides 4,4 connected to each coating width regulating plate 3. The sliding face 2 is flat, and provided with several slots 5, 6 in parallel. The lower end of the sliding face 2 is bent downward. As shown in FIG. 2, the upper corner on the coating solution stream side of the coating width regulating plate 3 is obliquely cut greatly to form an inclined face 32 successive to the remaining side wall (vertical face 31). The edge guide 4 is connected to the coating width regulating plate 3 integrally, and has the same section. The contact angle of the coating width regulating plate 3 is made greater than that of the edge guide 4. Each coating solution is extruded from a slot 6, 6, . . . and laminarly flows on the sliding face 2. Then, the laminar stream flows down from the lower end of the sliding face 2 with keeping both sides by the edge guides 4, 4, and meets to coat a web traveling underside (not illustrated).

EXAMPLES

Using the curtain coating apparatus as shown in FIG. 1, the following layers were applied to a polyethylene-coated baryta paper which had been provided with undercoating to produce a multiplayer color photographic paper having the following layer construction.

The composition of respective layers is shown below. The numerals in the right side represent coating amount ($g/m^2$). In the case of silver halide emulsion, the coating amount is of silver weight.

First Layer (Blue-Sensitive Emulsion Layer)

| | |
|---|---|
| Silver chlorobromide emulsion (cubic, mean particle size: 0.79, silver bromide; 0.3 mol. %) | 0.27 |
| Gelatin | 1.22 |

-continued

| | |
|---|---|
| Yellow coupler | 0.79 |
| Dye image stabilizer (Cpd-1) | 0.08 |
| Dye image stabilizer (Cpd-2) | 0.04 |
| Dye image stabilizer (Cpd-3) | 0.08 |
| Dye image stabilizer (Cpd-5) | 0.01 |
| Solvent (Solv-1) | 0.13 |
| Solvent (Solv-5) | 0.13 |

Second Layer (Color Miture Prevention Layer)

| | |
|---|---|
| Gelatin | 0.90 |
| Color miture preventive (Cpd-4) | 0.08 |
| Solvent (Solv-1) | 0.10 |
| Solvent (Solv-2) | 0.15 |
| Solvent (Solv-3) | 0.12 |
| Dye image stabilizer (Cpd-7) | 0.12 |
| Solvent (Solv-8) | 0.03 |

Third Layer (Green-Sensitive Emulsion Layer)

| | |
|---|---|
| Silver chlorobromide emulsion (cubic, mean particle size: 0.79, silver bromide; 0.3 mol. %) | 0.13 |
| Gelatin | 1.45 |
| Magenta coupler (ExM) | 0.16 |
| UV absorber (UV-2) | 0.16 |
| Dye image stabilizer (Cpd-2) | 0.03 |
| Color mixture preventive (Cpd-4) | 0.03 |
| Dye image stabilizer (Cpd-5) | 0.10 |
| Dye image stabilizer (Cpd-6) | 0.01 |
| Dye image stabilizer (Cpd-7) | 0.08 |
| Dye image stabilizer (Cpd-8) | 0.01 |
| Dye image stabilizer (Cpd-10) | 0.02 |
| Dye image stabilizer (Cpd-16) | 0.02 |
| Solvent (Solv-3) | 0.13 |
| Solvent (Solv-4) | 0.39 |
| Solvent (Solv-6) | 0.26 |

Fourth Layer (Color Mixture Prevention Layer)

| | |
|---|---|
| Gelatin | 0.68 |
| Color mixture preventive (Cpd-4) | 0.06 |
| Solvent (Solv-1) | 0.07 |
| Solvent (Solv-2) | 0.11 |
| Solvent (Solv-3) | 0.09 |
| Dye image stabilizer (Cpd-7) | 0.09 |
| Solvent (Solv-8) | 0.02 |

Fifth Layer (Red-Sensitive Emulsion Layer)

| | |
|---|---|
| Silver chlorobromide emulsion (cubic, mean particle size: 0.43 μm, silver bromide; 0.8 mol. %) | 0.18 |
| Gelatin | 0.80 |
| Cyan coupler (ExC) | 0.33 |
| UV absorber (UV-2) | 0.18 |
| Dye image stabilizer (Cpd-1) | 0.33 |
| Dye image stabilizer (Cpd-2) | 0.03 |
| Dye image stabilizer (Cpd-6) | 0.01 |
| Dye image stabilizer (Cpd-8) | 0.01 |
| Dye image stabilizer (Cpd-9) | 0.02 |
| Dye image stabilizer (Cpd-10) | 0.01 |
| Dye image stabilizer (Cpd-15) | 0.04 |
| Solvent (Solv-1) | 0.01 |
| Solvent (Solv-7) | 0.22 |

Sixth Layer (UV absorbing Layer)

| | |
|---|---|
| Gelatin | 0.48 |
| UV absorber (UV-1) | 0.38 |
| Dye image stabilizer (Cpd-5) | 0.01 |
| Dye image stabilizer (Cpd-7) | 0.05 |
| Solvent (Solv-10) | 0.03 |
| Solvent (Solv-9) | 0.03 |
| Stabilizer (Cpd-14) | 0.03 |

Seventh Layer (Protective Layer)

| | |
|---|---|
| Gelatin | 0.90 |
| Acryl-modified polyvinyl alcohol copolymer (modified degree: 17%) | 0.05 |
| Liquid paraffin | 0.02 |
| Dye image stabilizer (Cpd-11) | 0.01 |

Chemical structural formulas of the materials used in the above layers are as follows:

(ExY) Yellow Coupler

Mixture of 1:1 (molar ratio) of

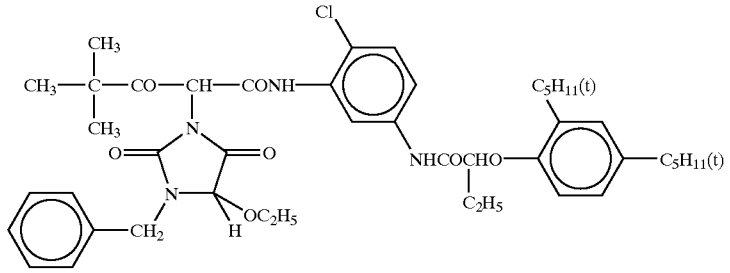

and

-continued
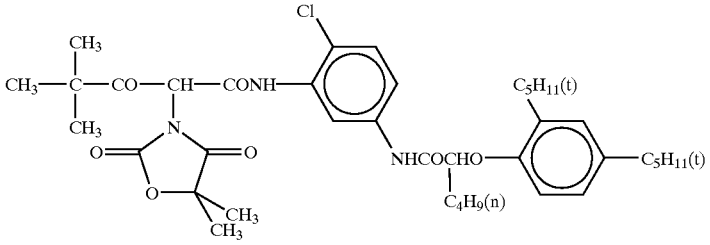
(ExM) Magenta Coupler
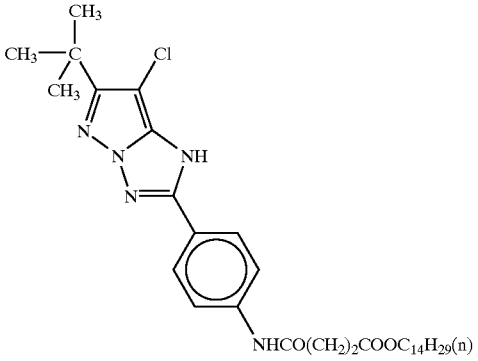
(ExC) Cyan Coupler
Mixture of 25:75 (molar ratio) of
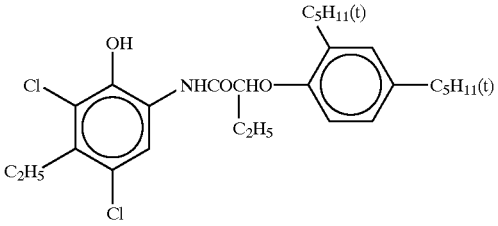
and
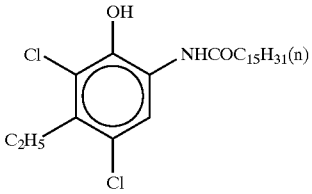
(Cpd-1) Dye Image Stabilizer
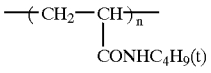
Number average molecular weight: 60,000
(Cpd-2) Dye Image Stabilizer
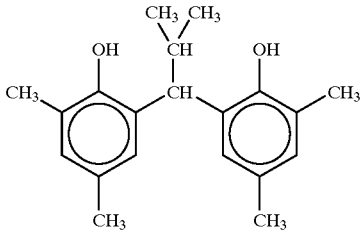
(Cpd-3) Dye Image Stabilizer
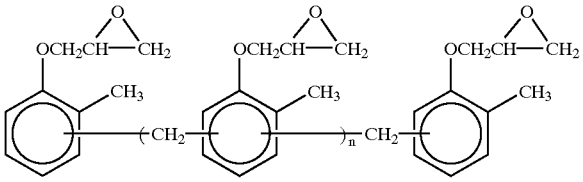
n=7–8 (average)
(Cpd-4) Color Mixture Preventive
Mixture of 1:1:1 (weight ratio) of
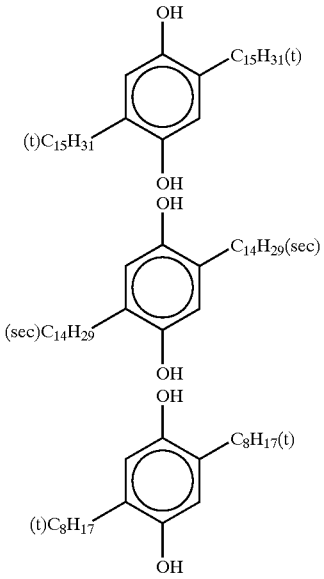

(Cpd-5) Dye Image Stabilizer
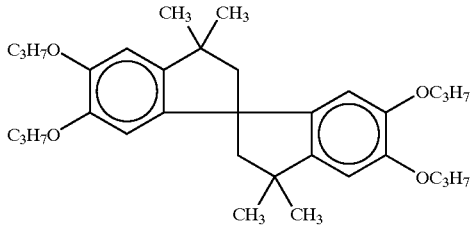
(Cpd-6) Dye Image Stabilizer
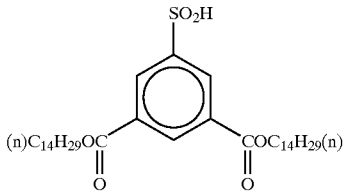
(Cpd-7) Dye Image Stabilizer
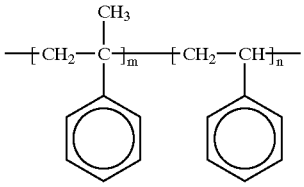
m/n=9/1
Number average molecular weight: 600
(Cpd-8) Dye Image Stabilizer
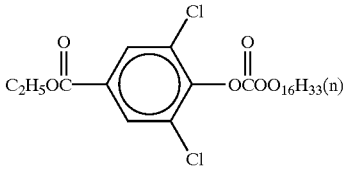
(Cpd-9) Dye Image Stabilizer
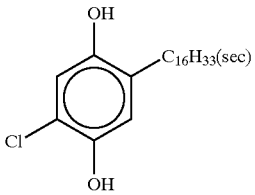
(Cpd-10) Dye Image Stabilizer
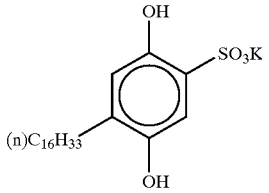
(Cpd-11)
Mixture of 1:2:1 (weight ratio) of
i)
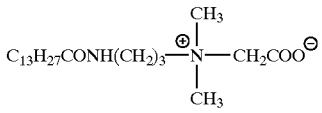
ii)
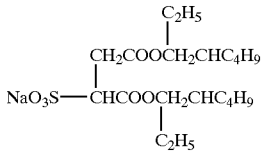
iii)
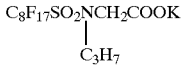
(Cpd-14) Stabilizer
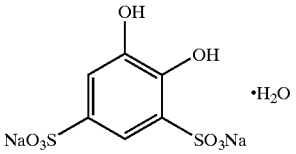
(Cpd-15) Dye Image Stabilizer
Methacrylic acid/n-butyl acrylate copolymer (40/60 ewight ratio)
(Cpd-16)
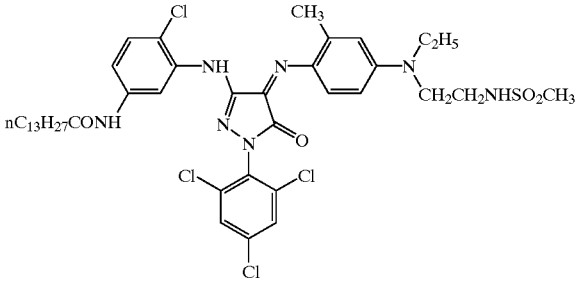

(UV-1) UV Absorber
Mixture of 1:2:2:3:1 (weight ratio) of
iv)
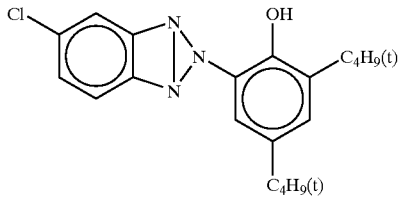
v)
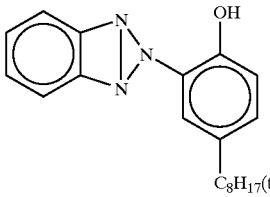
vi)
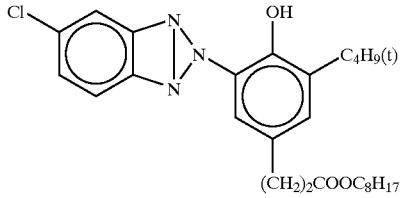
vii)
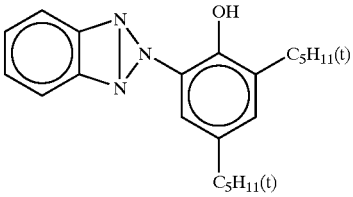
viii)
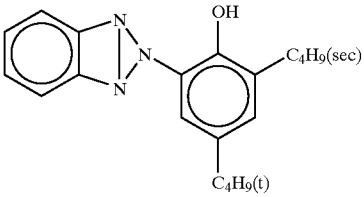
(UV-2) UV Absorber
Mixture of 2:3:4:1 (weight ratio) of
ix)
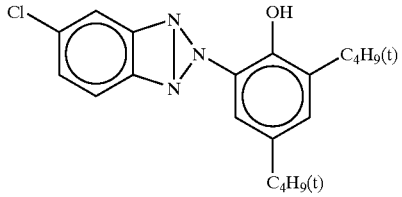
x)
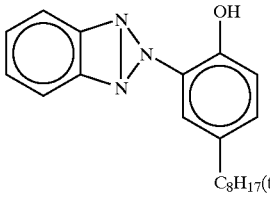
-continued
xi)
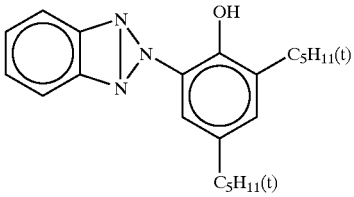
xii)
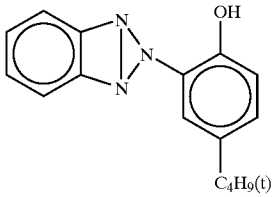
(Solv-1) Solvent
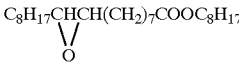
(Solv-2) Solvent
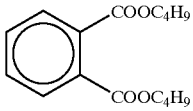
(Solv-3) Solvent
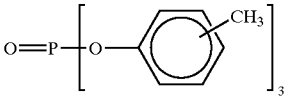
(Solv-4) Solvent
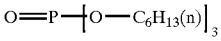
(Solv-5) Solvent
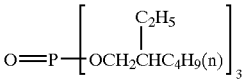
(Solv-6) Solvent
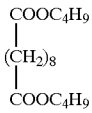

(Solv-7) Solvent

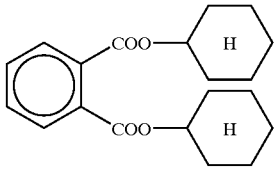

(Solv-8) Solvent

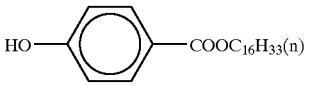

(Solv-9) Solvent

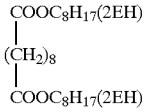

(Solv-10) Solvent

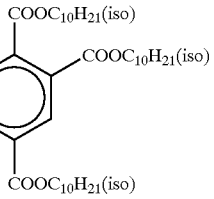

The flow rate per unit width of each free falling coating solution film was adjusted so as to become q=3, 4, 5, 6 (cc/cm/s) by adding water without changing the coating amount of the composition of respective layers, and their viscosity was adjusted by adding sodium polystyrene sulfonate as a thickener.

Coating tests were carried out with varying the relation between the contact angle of water with the coating width regulating plate and that with the edge guide, and surface quality of each coating was evaluated as to the uneven thickness at side ends of free falling liquid film and the occurrence of streaks.

The material of the coating width regulating plate and the edge guide were selected from stainless steel (SUS), acrylic resin (Acrylic), polyvinyl chloride (PVC) and polytetrafluoroethylene (PTFE).

In Examples 1 through 6 which were carried out under the conditions satisfying the formula (contact angle of water with coating width regulating plate)>(Contact angle of water with edge guide), coating surface quality was excellent in every example.

Conversely, in Comparative Examples / through 6 which were carried out under the conditions of the formula (contact angle of water with coating width regulating plate)<(Contact angle of water with edge guide), strong streaks and uneven thickness at film edge portions occurred.

In Comparative Examples 7 through 10 wherein the material of the edge guide was the same as the material of the coating width regulating plate, i.e. (contact angle of water with coating width regulating plate)=(Contact angle of water with edge guide), weak streaks and uneven thickness at film edge portions occurred.

In addition, in the case that the contact angle of water with the edge guide was the same as that with the coating width regulating plate, similar results were obtained, irrespective of coating amount.

The results are summarized in Table 1.

TABLE 1

| Material of Width Regulating | Material of Edge Guide | | | |
|---|---|---|---|---|
| Plate | SUS | Acrylic | PVC | PTFE |
| SUS | Comp. Ex. 7<br>Δ | Comp. Ex. 1<br>x | Comp. Ex. 2<br>x | Comp. Ex. 3<br>x |
| Acrylic | Ex. 1<br>○ | Comp. Ex. 8<br>Δ | Comp. Ex. 4<br>x | Comp. Ex. 5<br>x |
| PVC | Ex. 2<br>○ | Ex. 3<br>○ | Comp. Ex. 9<br>Δ | Comp. Ex. 6<br>x |
| PTFE | Ex. 4<br>○ | Ex. 5<br>○ | Ex. 6<br>○ | Comp. Ex. 10<br>Δ |

○ Good coating face quality
Δ Weak streaks and uneven thickness at film and portions
x Strong streaks and uneven thickness at film and portions Contact Angle against Water:

| | |
|---|---|
| SUS: | 20 degrees |
| Acrylic: | 80 degrees |
| PVC: | 87 degrees |
| PTFE: | 108 degrees |

It can be seen from the above results that, by selecting a combination satisfying the conditions of (Contact angle of water with a coating width regulating plate)>(Contact angle of water with an edge guide) as the material of the coating width regulating plate and the edge guide, the occurrence of streaks and the occurrence of uneven thickness at film edge portions can easily be inhibited.

Subsequently, effects of the height of the vertical face were examined. The material of the coating width regulating plate was polyvinyl chloride (PVC) or polytetrafluoroethylene (PTFE), and the material of the edge guide was stainless steel (SUS), acrylic resin (Acrylic) or polyvinyl chloride (PVC). The angle of the inclined face was 45 degrees. The results are shown in Table 2.

In Examples 7 and 8 and Comparative Examples 11 and 12, the contact angle of water with the coating width regulating plate was less than 95 degrees. In this case, when the height of the vertical face was less than 3 mm as shown in Examples 7 and 8, the coating face quality was good. However, when the height of the vertical face was 3 mm or more as shown in Comparative Examples 11 and 12, streaks and uneven thickness at film edge portions occurred (Table 2).

On the other hand, in Examples 9 and 10 and Comparative Examples 13 and 14, the contact angle of water with the coating width regulating plate was 95 degrees or more. In this case, when the height of the vertical face was 3 mm or more as shown in Examples 9 and 10, the coating face quality was good. However, when the height of the vertical face was 3 mm or more as shown in Comparative Examples 13 and 14, streaks and uneven thickness at film edge portions occurred (Table 2).

In the case that the relation of the contact angle and the height of the vertical face were not changed, similar results were obtained, irrespective of coating amount.

The results are summarized in Table 2

TABLE 2

| | Material | | | |
|---|---|---|---|---|
| | Regulating Plate | Edge Guide | Vertical Face Height (mm) | Coating Face Quality |
| Example 7 | PVC | SUS | 1 | Good |
| Example 8 | PVC | Acrylic | 1 | Good |
| Comparative 11 | PVC | SUS | 4 | Trouble |
| Comparative 12 | PVC | Acrylic | 4 | Trouble |
| Example 9 | PTFE | PVC | 4 | Good |
| Example 10 | PTFE | SUS | 4 | Good |
| Comparative 13 | PTFE | PVC | 1 | Trouble |
| Comparative 14 | PTFE | SUS | 1 | Trouble |

Trouble: Streaks and uneven thickness at film edge portions occurred.

Contact Angle against Water

| | |
|---|---|
| SUS: | 20 degrees |
| Acrylic: | 80 degrees |
| PVC: | 87 degrees |
| PTFE: | 108 degrees |

It can be seen from the above results that, the occurrence of streaks and uneven thickness at film edge portions can be inhibited by making the vertical face height less tan 3 mm for the contact angle of water with the coating width regulating plate of less than 95 degrees and by making the vertical face height 3 mm or more for the contact angle of water with the coating width regulating plate of 95 degrees or more.

Furthermore, the angle of the inclined face was changed, and coating tests were carried out under the conditions of Example 2.

The results are shown in Table 3.

TABLE 3

| | Angle (degree) | Coating Face Quality |
|---|---|---|
| Example 11 | 30 | Good |
| Example 12 | 50 | Good |
| Example 13 | 60 | Good |
| Comparative 15 | 15 | Trouble |
| Comparative 16 | 80 | Trouble |

Trouble: Streaks and uneven thickness at film edge portion occurred.

As can be seen from Table 3, it can be seen that a preferable angle of the inclined face is in the range of 30 to 60 degrees.

What is claimed is:

1. A curtain coating apparatus which comprises a sliding face on which a coating solution flows down, a coating width regulating plate which is located on each of both sides of the sliding face and regulates the width of the flow of the coating solution, and an edge guide which is connected to the width regulating plate, and keeps both side edges of free falling stream of the coating solution from the sliding face, wherein a contact angle of water with the coating width regulating plate is greater than a contact angle of water with the edge guide, the contact angle is calculated or measured using water as a testing agent.

2. The curtain coating apparatus of claim 1, wherein a contact angle of water with the coating width regulating plate is greater than a contact angle of water with the edge guide by 1 by 100 degrees.

3. The curtain coating apparatus of claim 1, wherein the coating width regulating plate has a lower vertical face and an upper inclined face inclined toward the outside connected to the vertical face on the coating solution stream side.

4. The curtain coating apparatus of claim 3, wherein the contact angle of water with the coating width regulating plate is less than 95 degrees, and the vertical face has a height of less than 3 mm.

5. The curtain coating apparatus of claim 3, wherein the contact angle of water with the coating width regulating plate is 95 degrees or more, and the vertical face has a height of 3 mm or more.

6. The curtain coating apparatus of claim 4, wherein the inclined face has an angle of inclination of 30 to 60 degrees.

7. The curtain coating apparatus of claim 5, wherein the inclined face has an angle of inclination of 30 to 60 degrees.

8. The curtain coating apparatus of claim 1, wherein the contact angle of water with the coating width regulating plate and the contact angle of water with the edge guide are controlled by forming the coating width regulating plate and the edge guide from different materials.

9. The curtain coating apparatus of claim 1, wherein the contact angle of water with the coating width regulating plate and the contact angle of water width the edge guide are controlled by surface treatment of one or both of the coating width regulating plate and the edge guide.

10. The curtain coating apparatus of claim 1, wherein the contact angle is calculated or measured using a contact angle measuring means using water as a testing agent.

* * * * *